US006643970B2

(12) United States Patent
Huber

(10) Patent No.: US 6,643,970 B2
(45) Date of Patent: Nov. 11, 2003

(54) ZERO STOP ADJUSTABLE RIFLE SCOPE

(76) Inventor: Jeffrey Huber, 127 Wisconsin St., Orofino, ID (US) 83544

( * ) Notice: Subject to any disclaimer, the term of this patent is extended or adjusted under 35 U.S.C. 154(b) by 0 days.

(21) Appl. No.: 10/061,832

(22) Filed: Jan. 31, 2002

(65) Prior Publication Data

US 2003/0140545 A1 Jul. 31, 2003

(51) Int. Cl.[7] ..... F41G 1/38
(52) U.S. Cl. ..... 42/122; 42/119
(58) Field of Search ..... 42/119, 122, 120, 42/124, 136, 138; 74/553

(56) References Cited

U.S. PATENT DOCUMENTS

| | | | | | |
|---|---|---|---|---|---|
| 3,297,389 | A | * | 1/1967 | Gibson | 359/424 |
| 3,826,012 | A | * | 7/1974 | Pachmayr | 42/122 |
| 3,990,155 | A | * | 11/1976 | Akin et al. | 42/122 |
| 4,014,123 | A | * | 3/1977 | Williams | 42/70.11 |
| 4,200,355 | A | * | 4/1980 | Williams, Jr. | 359/424 |
| 4,208,821 | A | * | 6/1980 | Power | 42/138 |
| 4,247,161 | A | * | 1/1981 | Unertl, Jr. | 359/424 |
| 4,373,269 | A | * | 2/1983 | Doliber et al. | 42/122 |
| 4,408,842 | A | * | 10/1983 | Gibson | 359/422 |
| 5,363,559 | A | * | 11/1994 | McCarty | 42/122 |
| 5,513,440 | A | * | 5/1996 | Murg | 42/122 |
| 5,615,487 | A | * | 4/1997 | Tomita | 42/122 |
| 5,771,595 | A | * | 6/1998 | Bell | 42/122 |
| 6,005,711 | A | * | 12/1999 | Mai et al. | 359/424 |
| 6,279,259 | B1 | * | 8/2001 | Otteman | 42/122 |
| 6,418,657 | B1 | * | 7/2002 | Brown | 42/124 |
| 6,442,854 | B1 | * | 9/2002 | Liu et al. | 33/286 |
| 6,481,146 | B2 | * | 11/2002 | Carrier, III | 42/136 |
| 6,508,144 | B1 | * | 1/2003 | Vendetti et al. | 74/553 |
| 6,519,890 | B1 | * | 2/2003 | Otteman | 42/122 |

* cited by examiner

*Primary Examiner*—Michael J. Carone
*Assistant Examiner*—Troy Chambers
(74) *Attorney, Agent, or Firm*—Dean A. Craine

(57) ABSTRACT

A "zero stop" rifle scope adjustment mechanism that allows a user to establish the "zero point" at any point in the scope range, and still maintain ¼ minute clicks and with unlimited rotations of the adjustment knob. The mechanism includes a T-shaped adjustment bolt that is vertically aligned inside an adjustment body fixed in position on the turret of the rifle scope. The adjustment body includes a small threaded central bore to which the adjustment bolt is attached. The adjustment body also includes an upward cavity with splines formed on the inside surface. When assembled, the threaded upper section of the adjacent bolt extends above the top surface of the adjustment body. Disposed longitudinally and locked in position over the threaded upper section of the adjustment bolt and around the adjustment body is an index dial. Attached to the threaded upper section that extends above the index dial is a stop ring and a lock ring that are selectively locked together on the upper section of the adjustment bolt. A tab element is formed on the top surface of the index dial body which is engaged by a complimentary-shaped tongue member of the stop ring which locks the index dial body and stop plate together to prevent further downward rotation of the stop plate over the body. An outer cap is then longitudinally aligned and inserted over the stop ring, lock ring, index dial, and the adjustment body. The outer cap includes locking screw which when tightened, is forced against the lock ring to lock the outer cap thereto.

18 Claims, 5 Drawing Sheets

ZERO STOP ADJUSTABLE RIFLE SCOPE

BACKGROUND OF THE INVENTION

1. Field of the Invention

This invention relates to telescopic scopes used with firearms and, more particularly, to scopes that can be "zeroed-in" for more accurate long range shooting.

2. Description of the Related Art

Riflescopes, telescopic scopes for rifles, are commonly used by hunters to aim their rifles at selected targets. During use, the hunter looks into the scope and positions the target within the field of view of the scope reticle. Because gravity causes the bullets to drop when they exit the rifle barrel, the angular position of the scope with respect to the rifle barrel must be compensated so that the impact point of the bullet matches the target seen on the scope reticle. The act of adjusting the angular position of the scope with respect to the rifle barrel is known as "zeroing-in".

Typically, a scope is zeroed-in by the hunter when firing bullets at a target at a known distance. After viewing a group of impacts on the target, the hunter determines the distance of drop and then adjusts the angular position of the scope with respect to the rifle barrel. The hunter continues to use this "trial by error" method until the scope proper position, known as the "zero point", is determined.

Many scopes include adjustment knobs that enable the hunter to easily "zero-in"0 the scope and adjust the angular position of the scope for targets at distances greater than the distance used to "zero-in" the scope. For example, if the scope is "zeroed-in" at 200 yards, the adjustment knob may be used to adjust the angular position of the scope so that the reticle accurately views the more distant impact point (i.e. target). If the target moves towards or away from the user (i.e. 250 yards), the hunter must quickly readjust the adjustment knob so that the scope is positioned correctly.

In order to quickly readjust the angular position of the scope, the hunter must remember the adjustment knob current setting, the direction of rotation to increase or decrease the angle, and the number of "clicks", or rotations of the knob, needed for the new setting. If the clicks are difficult to hear or feel or if the environment is dark, accurate adjustments can be difficult or impossible to make.

In order to prevent confusion, most scope manufacturers limit the movement of the adjustment knob to less than two rotations. Also, most scope manufacturers calibrate the adjustment knobs so that there are 60 to 120 clicks in one rotation and one click is equal to 1 inch to ½ inch adjustment in elevation of the target at 100 yards. Using this calibration standard, a typical scope maximum range of adjustment at 100 yards is 60 inches. When the above method is used to "zero-in" the scope, a substantial amount of rotation may have been used. Thus, the total number of clicks available for adjusting the position of the scope is reduced which seriously limits the usefulness of the rifle for shooting at long-range targets. Another drawback with using a relatively large calibration such as a "1 click equals 1 inch standard" is that it introduces a greater error at greater ranges. For example, if a target is located at 300 yards, an error of one click represents 3 inches in elevation.

What is needed is a scope elevation adjustment mechanism that enables the user to easily "zero-in" the scope at any position and still allow for full and unlimited rotation of the adjustment knob, and that also allows the adjustment knob to be used for finer adjustments.

SUMMARY OF THE INVENTION

It is an object of the present invention to provide a riflescope with an adjustment knob for changing the angular position of the rector tube.

It is another object of the present invention to provide such a riflescope that enables the user to set the "zero-in" point on the riflescope at any point of the riflescope range and still use the full range of adjustment of the adjustment knob.

It is a further object of the present invention to provide such a riflescope that uses "¼ minute per click" fine adjustment setting for greater accuracy.

These and other objects are met by a zero stop riflescope adjustment mechanism that allows a user to establish the "zero point" at any point in the range of the scope, and still maintain ¼ minute clicks and unlimited rotations of the adjustment knob. The mechanism includes an adjustment bolt longitudinally aligned inside a cylindrical-shaped adjustment body that fits into a standard threaded hole formed on the turret of the riflescope. The adjustment bolt is a T-shaped structure with upper and lower threaded sections and a wide, central circular collar. During assembly, the lower threaded section of the adjustment bolt is connected to a lower threaded bore formed inside the adjustment body. The lower neck of the adjustment body connects to the threaded bore while the lower end extends into the hole formed on the turret and contacts the rector tube. When the adjustment bolt is rotated inside the adjustment body threaded bore, the distal end of the adjustment bolt advances or withdraws from the hole in the turret to change the angular position of the rector tube inside the riflescope.

When the adjustment bolt is properly connected to the adjustment body, the upper section of the adjustment bolt extends above the top surface of the adjustment body. Disposed longitudinally over the adjustment body is an index dial with a central bore formed therein that receives the threaded upper section of the adjustment bolt that extends above the adjustment body. The index dial includes a top surface with a central bore formed therein and a vertically aligned index line formed on its outside surface. During assembly, after the adjustment body is tightened and securely attached to the turret, the index dial is aligned over the adjustment body so that the threaded upper section extends through the index dial and the index line faces the shooter. An upward extending tab element is formed on the top surface of the index dial which acts as a stop surface for a downward extending tongue member on the bottom surface of the stop ring. After the adjustment body is tightened and securely attached to the turret, the index dial is aligned over the adjustment body and locked in position so that the index line faces the shooter.

Threadingly attached to the threaded upper section of the adjustment bolt that extends above the index dial is a stop ring. Attached to the outer perimeter of the stop ring is a downward extending tongue member that contacts the upward extending tab element formed on the index dial when the stop ring is rotated downward and positioned against the index dial. Together, the tab element and tongue member act as a stop means to prevent downward advancement of the stop ring over the adjustment bolt.

Threadingly attached to the threaded upper section on the adjustment bolt and above the stop ring is a lock ring. During use, the lock ring is rotated downwardly over the threaded upper section until it is pressed tightly against the top surface of the stop ring. Connecting means, such as screws, are then used to connect the lock ring and stop ring together which pinches them against the threads on the adjustment bolt thereby securely locking the lock ring and stop ring in a fixed position on the adjustment bolt. When the lock ring is rotated, the adjustment bolt is rotated inside the adjustment body until further downward rotation of the adjustment bolt is prevented by the index dial containing the stop ring.

A cylindrical-shaped outer cap is then longitudinally aligned and inserted over the threaded upper section of the adjustment bolt, the lock and stop rings, the index dial, and the adjustment body. A locking screw is then used to lock the outer cap to the lock ring.

Formed inside the upward extending cavity inside the adjustment body is a plurality of longitudinally aligned splines. As mentioned above, the adjustment bolt is initially attached to the threaded bore formed in the adjustment body. When properly connected thereto, the outer surface of the bolt circular collar extends outward and is disposed adjacent to the splines formed on the adjustment body. Disposed on the outer surface of the circular collar is a transversely aligned ball screw which extends outward and contacts one of the splines. When the adjustment bolt is rotated, the ball screw travels over the splines thereby providing a rotational, resistant force and making a characteristic "clicking" sound. The ball screw may include an optional tension adjustment means that enables the user to set the outward force exerted by the ball screw over the splines thereby enabling the user to adjust the amount of torque required to turn the adjustment bolt.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DESCRIPTION OF THE PREFERRED EMBODIMENT(S)

Referring to the accompanying Figs., there is shown and described an adjustable zero stop scope mechanism 8 for a riflescope that allows a user to establish the "zero point" at any point in the scope range, and still maintain ¼ minute clicks and with unlimited rotations of the outer cap 60.

Figure 1:
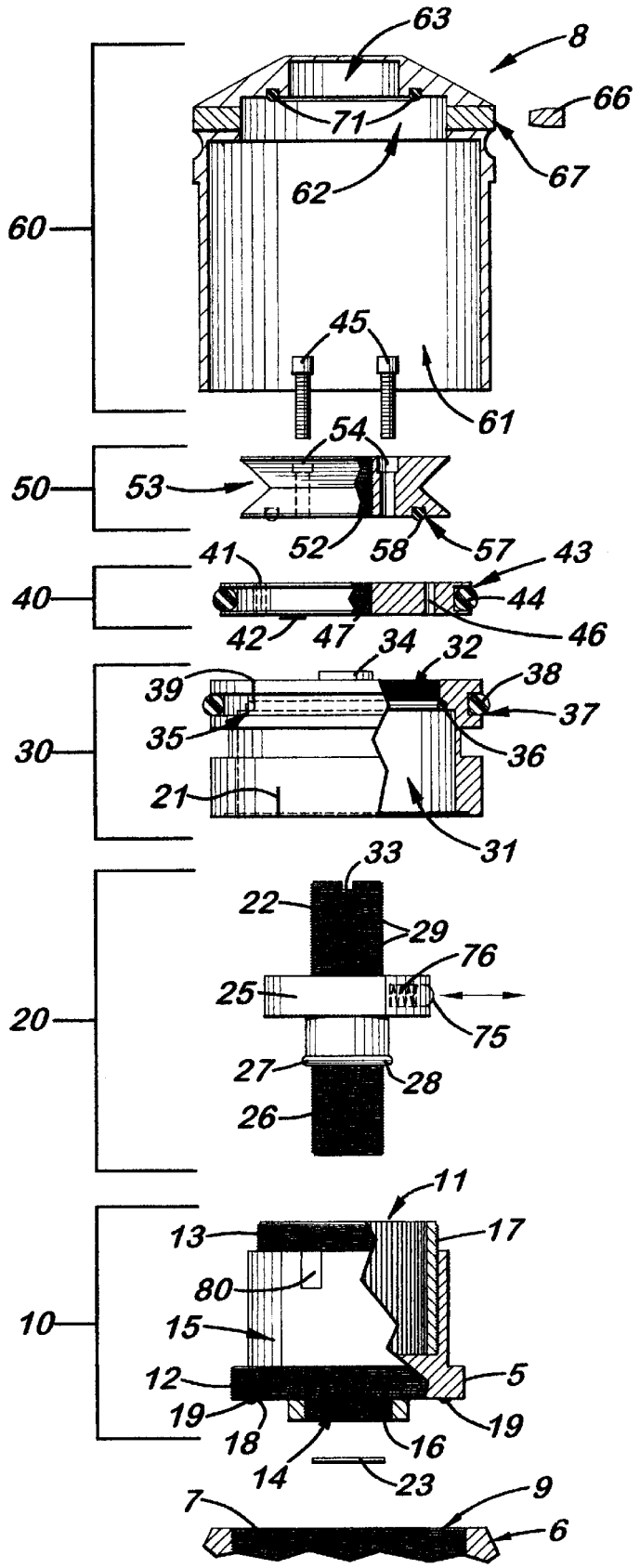
FIG. 1 is an exploded side elevational view, partially in section, of the zero stop adjustable riflescope mechanism for a riflescope disclosed herein.
Figure 2:
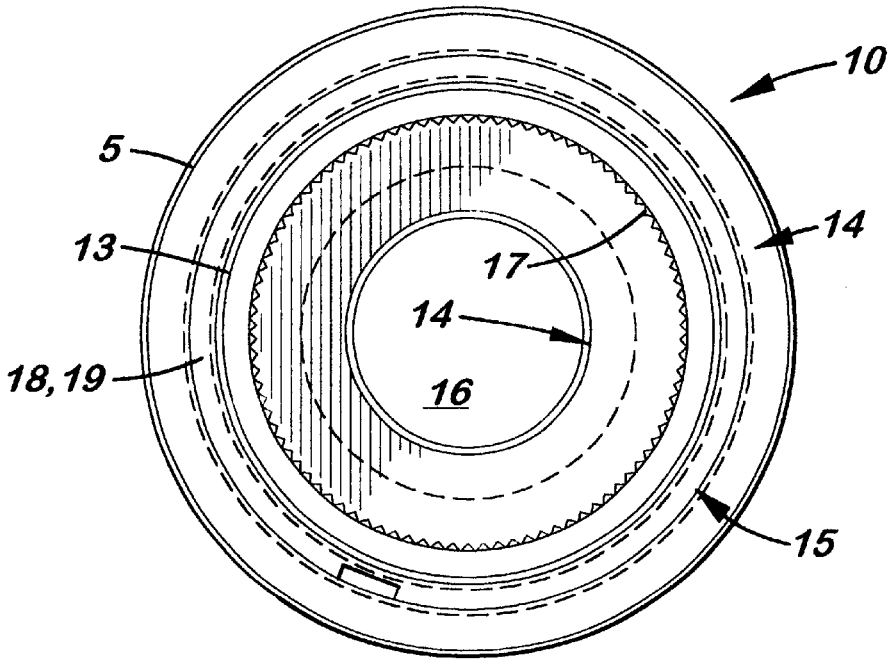
FIG. 2 is a top plan view of the adjustment body.
Figure 3:
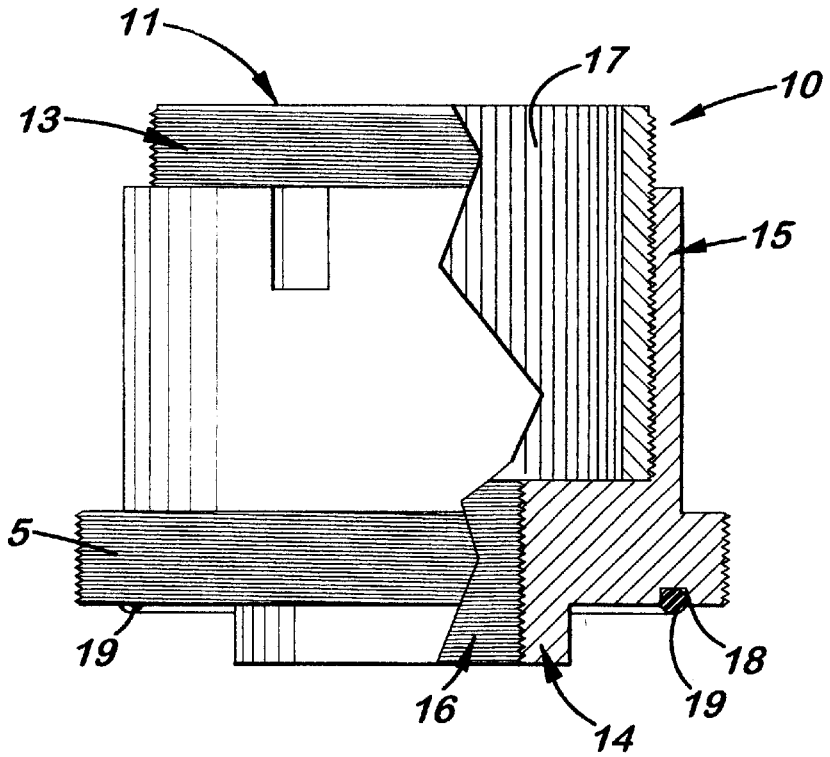
FIG. 3 is a side elevational view partially in section of the adjustment body.

The mechanism 8 includes an adjustment bolt 20 vertically aligned inside a cylindrical-shaped adjustment body 10 that fits into a hole 9 formed on the turret 6 of a riflescope (not shown). The adjustment body 10, shown more clearly in FIGS. 1–3, is a cylindrical-shaped structure with a lower threaded base 12 and an upper section 15. Formed inside the upper section 15 is a central cavity 11. Extending downward from the threaded base 12 is a longitudinally aligned collar 14. Formed inside the collar 14 is a threaded bore 16. Formed inside the central cavity 11 is a plurality of longitudinally aligned splines 17, and formed on the lower surface of the threaded base 12 is an optional circular slot 18 in which an O-ring 19 is disposed. During assembly, the threaded base 12 connects to internal threads 7 on the turret 6.

Figure 4:
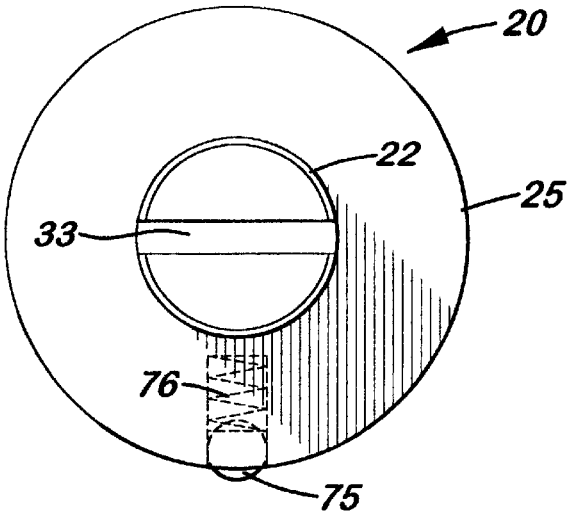
FIG. 4 is a top plan view of the adjustment bolt.
Figure 5:
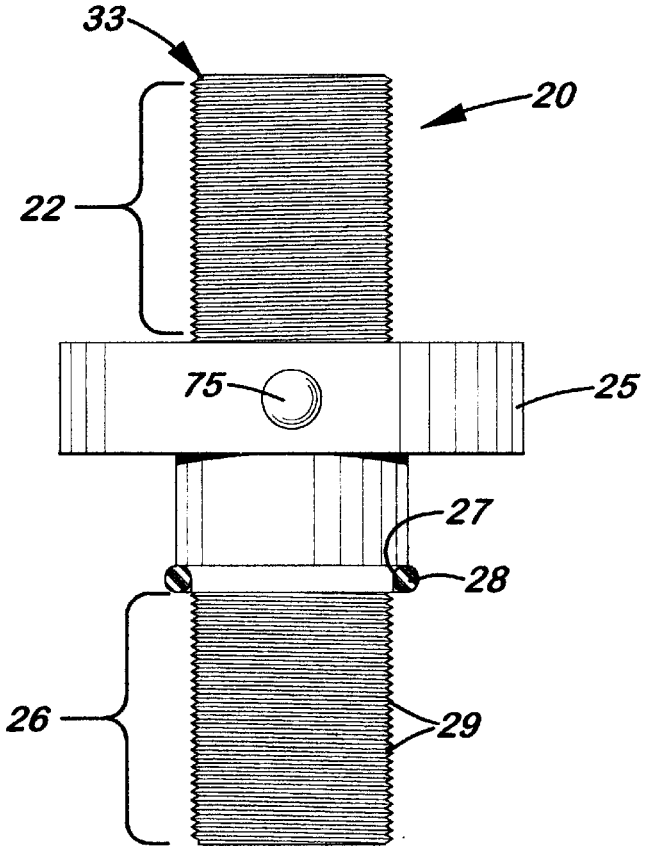
FIG. 5 is a side elevational view of the adjustment bolt.

The adjustment bolt 20 shown in FIGS. 1, 4 and 5 is a T-shaped structure with upper and lower threaded sections 22, 26, respectively, and a wide, central circular collar 25. During assembly, the lower threaded section 26 is connected to the threaded bore 16 formed inside the adjustment body 10. When the adjustment bolt 20 is rotated inside the threaded bore 16, the distal end of the adjustment bolt 20 advances or withdraws from the adjustment body 10 to change the angular position of the rector tube (not shown) which extends longitudinally inside the riflescope below the turret 6. An optional lock washer 23, shown in FIG. 1, may be attached to the end of the lower threaded section 26 of the adjustment bolt 20 to prevent the adjustment bolt 20 from being withdrawn completely from the threaded bore 16 during operation. Also formed above the lower threaded section 26 is an optional O-ring slot 27 which receives an O-ring 28 to provide a watertight seal between the adjoining parts. A transversely aligned slot 33 is formed on the top surface of the adjustment bolt 20 so that the adjustment bolt 20 may be turned with the edge of a screwdriver or coin when the outer cap 60 is removed.

Figure 6:
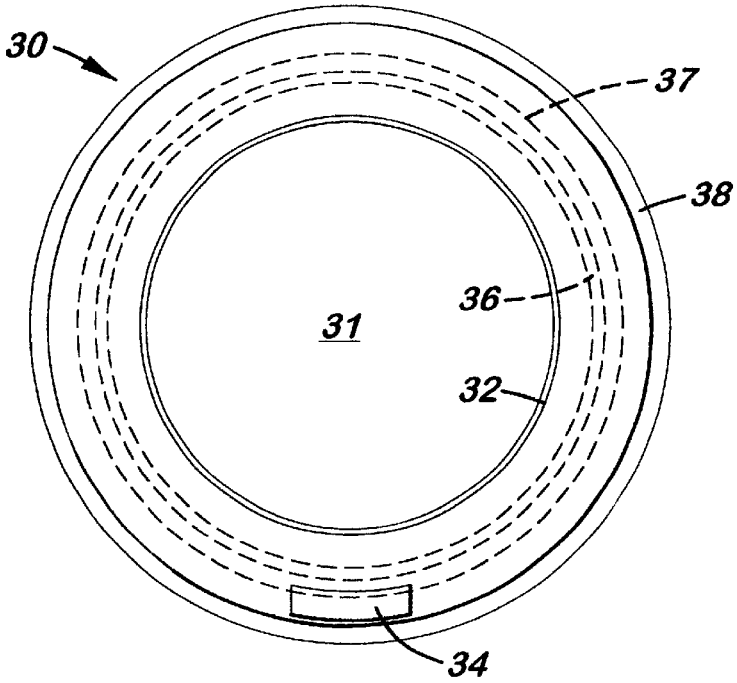
FIG. 6 is a top plan view of the index dial.

As shown in FIG. 1, disposed longitudinally over the adjustment body 10 is a cylindrical-shaped index dial 30. The index dial 30, shown also in FIG. 6, includes a fully extending central bore 31 that allows the index dial 30 to fit over the upper section 15 on the adjustment body 10. Formed on the top portion of the index dial 30 is a small central threaded bore 32 designed to attach to the external threads formed on the threaded base 12 of the adjustment body 10. Formed on the lower inside edge of the threaded neck 13 is an optional recessed O-ring slot 35 and O-ring 36. Located on the perimeter edge of the index dial 30 is a circular slot 37 that receives an outer O-ring 38 to provide a watertight seal between the index dial 30 and the outer cap 60 when longitudinally aligned thereover as discussed above. The index dial 30 includes a vertically aligned index line 21 printed or formed on the outside surface. Index dial 30 also includes an upward extending tab element 34 formed on the top surface. In the preferred embodiment, the width of the tab element 34 is approximately 20 degrees arc. During manufacturing, after the adjustment body 10 is tightened and securely attached to the turret 6, the index dial 30 is then aligned and rotatably fitted over the adjustment body 10 so that the index line 21 faces the shooter. The manufacturer then center punches the side of the index dial 30 located over the recessed area 80 on the adjustment body 10 to lock the index dial 30 onto the adjustment body 10.

Figure 7:
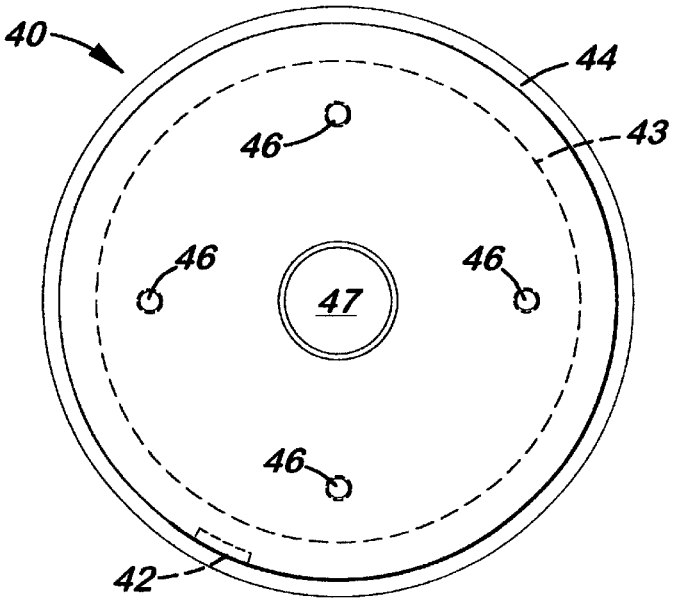
FIG. 7 is a top plan view of the stop ring.

Threadingly attached to the threaded upper section 22 of the adjustment bolt 20 that extends above the index dial 30 after assembly is a stop ring 40. The stop ring 40, shown in FIGS. 1 and 7, includes a central, threaded bore 47 that connects to the upper section 22 of the adjustment bolt 20. The bore 47 is used as a stop surface to prevent undesirable advancement of the adjustment bolt 20 into the adjustment body 10. Attached to the outer perimeter of the stop ring 40 is a tongue member 42 which makes contact with the tab element 34 formed on the top surface of the index dial 30 when the stop ring 40 is rotated downward and against the index dial 30. Together, the tab element 34 and tongue member 42 act as stop means to prevent further downward advancement of the stop ring 40 over the adjustment bolt 20. Aligned radially and evenly spaced on the stop ring 40 are four threaded bores 46 that connect to screws 45 that extend downward from the lock ring 50. The perimeter edge 43 of the stop ring 40 is recessed and designed to receive an optional O-ring 44.

Figure 8:
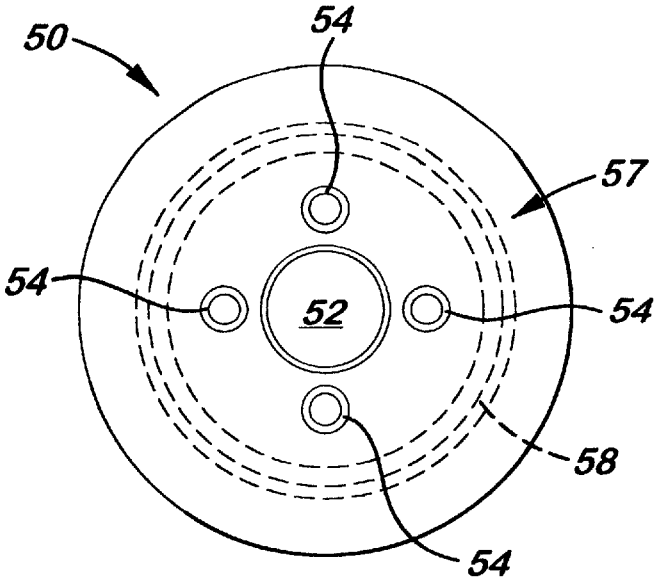
FIG. 8 is a top plan view of the lock ring.

Threadingly attached to the threaded upper section 22 on the adjustment bolt 20 that extends above the stop ring 40 is a lock ring 50. The lock ring 50, shown in FIGS. 1 and 8, is a pulley-shaped structure with a transversely aligned, circular, V-shaped slot 53 and a central threaded bore 52 that connects to the threaded upper surface 22 on the adjustment bolt 20. The slot 53 is designed to receive a screw 66 that extends transversely from the outer cap 60 to securely attach the outer cap 60 to the lock ring 50. Formed radially on the lock ring 50 are four counter-sunk threaded bores 54 designed to receive threaded screws 45. Formed inside the lock ring 50 is a central threaded bore 52 designed to connect to the threaded upper section 22 on the adjustment bolt 20.

During use, the lock ring 50 is rotated downwardly over the adjustment bolt 20 and pressed tightly against the top surface 41 of the stop ring 40. The screws 45 are then used to connect the lock ring 50 and stop ring 40 together. When connected together, the stop ring 40 and lock ring 50 are pinched against the threads 29 on the threaded upper section 22 on the adjustment bolt 20 thereby securely locking the stop ring 40 and lock ring 50 to the adjustment bolt 20. Rotation of the lock ring 50 thereby rotates the adjustment bolt 20 inside the adjustment body 10 until further downward rotation is prevented by the stop ring 40 hitting the top surface 39 of the index dial 30.

Figure 9:
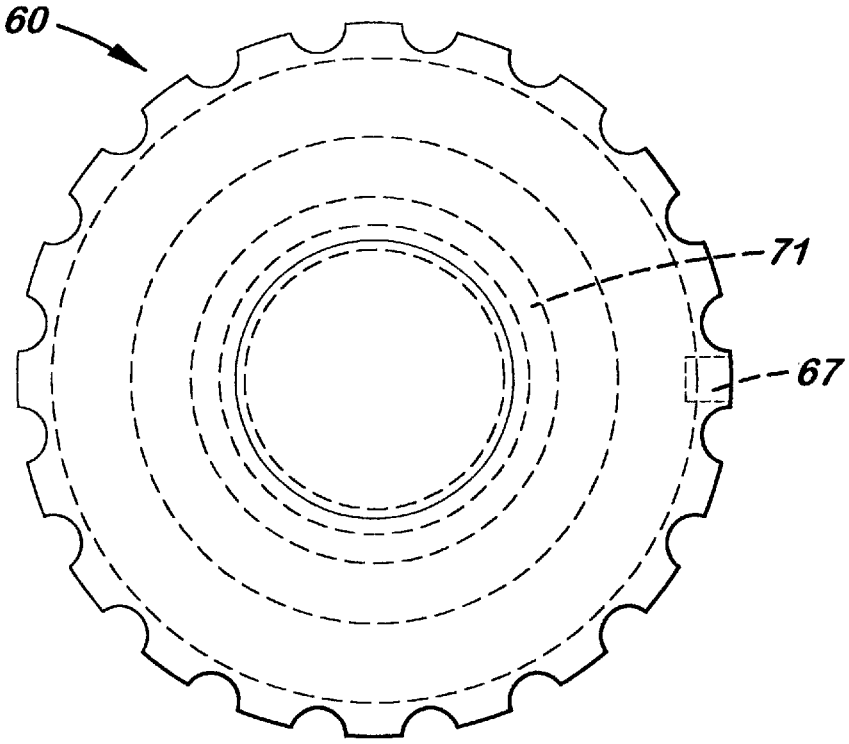
FIG. 9 is a top plan view of the outer cap.

The hollow cylindrical-shaped outer cap 60, shown in FIGS. 1 and 9, is longitudinally aligned and inserted over the adjustment body 10, the adjustment bolt 20, the index dial 30, and the stop and lock rings 40, 50, respectively. Formed centrally inside the outer cap 60 is a wide cylindrical cavity 61 that receives the index dial 30 and stop ring 40 and an upper, smaller, circular recessed space 62 designed to receive the lock ring 50 when the outer cap 60 is placed over the adjustment bolt 20. Located above the recessed space 62 is a small circular space 63 designed to receive the top end of the adjustment bolt 20. Located inside the recessed space 62 and on the outer cap 60 is an O-ring 71 that presses against the top surface of the lock ring 50 to create a watertight seal between the outer cap 60 and the lock ring 50. Located on the upper section of the outer cap 60 is a side mounted screw 66 that fits into a laterally extended threaded bore 67 that communicates with the recessed space 62. During use, the screw 66 is sufficiently tightened inside the bore 67 to press against the sides of the lock ring 50 to lock the outer cap 60 to the lock ring 50 and securely attach the outer cap 60 to the adjustment bolt 20.

Formed inside the adjustment body 10 is a central, upward extending cavity 11 with a plurality of longitudinally aligned splines 17 formed therein. As mentioned above, when the adjustment bolt 20 is attached to the threaded collar 14, the central collar 25 extends outward and is disposed near the splines 17. Located on the outer surface of the collar 25 is a transversely aligned ball screw 75 that makes contact with the splines 17 when the adjustment bolt 20 is properly positioned inside the adjustment body 10. When the adjustment bolt 20 is rotated inside the adjustment body 10, the ball screw 75 travels over the splines 17 thereby making a characteristic clicking sound. The ball screw 75 may include an optional tension adjustment means, such as a spring 76, shown in FIG. 4, that enables the user to selectively adjust the outward force exerted by the ball screw 75 over the splines 17 to adjust the amount of torque required to turn the outer cap 60.

In the preferred embodiment, the upper section 15 of the adjustment body 10 is approximately 0.774 inch in height and 1.04 inch in diameter. The threaded base 12 is approximately 0.200 inch in height and 1.300 inch in diameter. The threaded collar 14 is approximately 0.80 inch in diameter with external threads 5 measuring 20 per inch. The central, upward extending cavity 11 is approximately 0.8 inch in diameter with sixty splines 17 formed therein. In the preferred embodiment, the index dial 30 measures approximately 1.137 inch in diameter, and 0.562 inch in height. The tab element 34 extends upward approximately 0.025 inch and the tongue member 42 extends downward approximately 0.015 inch.

The adjustment bolt 20 is made of brass alloy and measures approximately 1.5 inches in length. The upper and lower threaded sections 22, 26, respectively, are approximately 0.56 inch in length and 0.300 inch in diameter. The central collar 25 is approximately 1.00 inch in diameter and 0.25 inch in thickness. The ball screw 75 is approximately 0.030 inch in diameter and 0.2 inch in length. A slot 33 is formed on the top surface of the adjustment bolt 20 so that adjustment bolt 20 may be turned with a screw driver or coin when the outer cap 60 is removed.

The stop ring 40 is a flat, washer-shaped element made of aluminum and measures approximately 1.230 inch in diameter and 0.150 inch in thickness. The four radially aligned threaded bores 46 (one shown) are 0.05 inch in diameter.

The lock ring 50 is a flat, pulley-like element with a central threaded bore 52 designed to attach to the upper section 22 of the adjustment bolt 20. Formed transversely on the lock ring 50 are four recessed bores 54 designed to receive small threaded screws 45 that connect to the threaded bores 46 formed on the stop ring 40. Formed on the lower surface of the lock ring 50 is a circular O-ring slot 57 designed to receive an O-ring 58. The lock ring 50 is made of aluminum and is approximately 1.05 inch in diameter and 0.400 inch in height. The outer cap 60 is approximately 1.30 inch in diameter and 1.06 inch in height. The center cavity 61 is approximately 1.25 inch in diameter and 0.90 inch in height.

To set a zero stop, the outer cap 60 is removed and the lock ring 50 is disconnected from the stop ring 40. The adjustment bolt 20 is then manually rotated using the tip of a screwdriver or coin inside slot 33 until the desired zero stop for the rector tube is found. Keeping the adjustment bolt 20 in a fixed position on the index dial 30, the stop ring 50 is then rotated downward over the adjustment bolt 20 until the tongue member 42 is blocked by the tab element 34 on the index dial 30. By rotating the stop ring 40 downward over the adjustment bolt 20, the entire length of the adjustment bolt 20 may be used to later change the zero stop to a greater distance.

The lock ring 50 is then rotated downward onto the adjustment bolt 20 until the lock ring 50 makes contact with the stop ring 40. The stop ring 40 and lock ring 50 are then locked together to bind to the adjustment bolt 20 by tightening screws 45. The outer cap 60 is then disposed over the upper end of the adjustment bolt 20, the index dial 30 and the adjustment body 10. The outer cap 60 is then locked to the lock ring 50 via a side mounted screw 66 which inserts into the threaded bore 67 formed on the outer cap 60.

The threads in the threaded collar 14, the slope of the threads, the sections 22 and 26 of adjustment bolt 20, the number of splines 17 used in the adjustment body 10, and the width of the tab element 34 are sufficient so that ¼ minute clicks of adjustment are provided.

In compliance with the statute, the invention described herein has been described in language more or less specific as to structural features. It should be understood, however, that the invention is not limited to the embodiments described herein or to specific features shown, since the means and construction shown, comprised only of the preferred embodiments for putting the invention into effect. It is also understood that the phraseology and terminology employed herein are for the purpose of description and should not be regarded as limiting. The invention is therefore claimed in any of its forms or modifications within the legitimate and valid scope of the amended claims, appropriately interpreted in accordance with the doctrine of equivalents.

Further, the purpose of the foregoing abstract is to enable the U.S. Patent and Trademark Office personnel, patent bar practitioners, and the general public, to determine quickly from a cursory inspection the nature and essence of the technical disclosure of the application. The Abstract is neither intended to define the invention of the Application, which is measured by the claim, nor is it intended to be limiting as the scope of the invention in any way.

I claim:

1. A rifle scope adjustable zero stop mechanism that fits into hole formed in a turret and used to adjust the vertical position of the rector tube inside the rifle scope, said adjustment mechanisms comprising:

a. an adjustment body with a lower threaded section that connects to a turret, said adjustment body including a longitudinally aligned threaded bore and a central cavity including a plurality of longitudinally aligned splines formed therein;

b. an adjustment bolt having a threaded upper section end and a threaded lower section, said threaded lower section connected to said threaded bore in said adjustment body, said adjustment bolt being longer in length than said adjustment body so that when said threaded lower section is connected to said threaded bore, said lower section extends downward and contacts a rector tube inside a rifle scope and threaded upper section extends above said adjustment body;

c. a stop ring having a threaded bore that connects to said threaded upper section of said adjustment bolt;

d. a lock ring having a threaded bore that connects to said threaded upper section on said adjustment bolt and above said stop ring;

e. means to lock said lock ring and stop ring together on said threaded upper section on said adjustment bolt; and, f. a cylindrical outer cap aligned vertically over said adjustment body, said upper section of said adjustment bolt and said stop ring, said outer cap;

g. means to connect said outer cap to said lock ring; and, h. whereby when said outer cap is rotated, said adjustment bolt is rotated inside said adjustment body to a desired zero stop position, said lock plate is rotated over said adjustment bolt until said lock plate and stop plate are adjacent and said means to connect said lock plate and said stop plate is used to lock said lock plate and said stop ring.

2. The mechanism as recited in claim 1, further including an index dial disposed over and locked onto said adjustment body to provide a reference point upon which the amount of rotation of said outer cap may be measured.

3. The mechanism as recited in claim 2, further including a resistant means formed between said adjustment bolt and said adjustment body.

4. The mechanism as recited in claim 3, wherein said resistant means includes a plurality of splines formed inside said adjustment body and a circular central collar formed on said adjustment bolt and at least one screwball formed on said central collar that resistantly travels over said splines.

5. The mechanism as recited in claim 4, further including a spring attached to said screwball to provide a selectively adjustable force that resists rotation of said adjustment bolt inside said central circular collar.

6. The mechanism as recited in claim 4, further including a tab member and a tongue member formed on the adjacent surfaces of said stop ring and said lock ring which are aligned when said stop ring and said lock ring are rotated on said adjustment bolt and immediately adjacent to each other.

7. A mechanism as recited in claim 1, wherein said means to lock said lock ring and said stop ring on said adjustment bolt is at least one screw transversely aligned on said lock ring that connects to said stop ring to bind said lock ring and said stop ring together to said adjustment bolt.

8. The mechanism as recited in claim 1, wherein said means to connect said outer cap to said locking ring is a transversely aligned pin on said outer cap that selectively engages said lock ring.

9. The mechanism as recited in claim 1, wherein said adjustment bolt includes a transversely aligned slot formed on said upper extended end of said adjustment bolt to enable a suitable tool to be inserted therein to rotate said adjustment bolt.

10. The mechanism as recited in claim 1, further including a lock washer attached to the lower section of said adjustment bolt extending through said adjustment body to prevent withdrawal of said adjustment bolt from said adjustment body.

11. The mechanism as recited in claim 7, further including a ring washer disposed between said adjustment body and said turret to provide a watertight joint therebetween.

12. The mechanism as recited in claim 1, further including at least one O-ring attached to said lock ring to create a watertight seal between said lock ring and said outer cover.

13. An adjustable zero stop mechanism, comprising:

a. an adjustment body attached to the turret on a rifle scope;

b. an adjustment bolt threadingly connected to said adjustment body, said adjustment bolt able to advance or withdraw from said adjustment body and change the position of a rector inside said scope;

c. an index dial disposed over and locked onto said adjustment bolt, said index dial including an upward extending tab element;

d. an adjustable stop ring attached to said adjustment body used to indicate the desired amount of movement of said adjustment bolt from said adjustment body, including a downward extending tongue member that engages said tab element to prevent the downward movement of said stop ring over said adjustment bolt;

e. a lock plate threadingly attachable to said adjustment bolt, said lock plate including means to engage said stop ring;

f. an outer cap that covers said adjustment body, said adjustment bolt when connected to said adjustment body, and said index dial when connected to said adjustment body; and, g. means to connect said outer cap to said lock ring.

14. The mechanism as recited in claim 13, further including an index line located on said index dial to provide a reference point upon which the amount of rotation of said outer cap may be measured.

15. The mechanism as recited in claim 14, further including a resistant means formed between said adjustment bolt and said adjustment body.

16. The mechanism as recited in claim 15, wherein said resistant means is a ball screw attached to said adjustment bolt and a plurality of splines formed on the inside surface of said adjustment body.

17. The mechanism as recited in claim 15, wherein said ball screw is spring loaded and adjustable in length thereby enabling the amount of resistance exerted on said splines to be adjusted.

18. A mechanism as recited in claim 16, wherein said means to lock said lock ring and said stop ring on said adjustment bolt is at least one screw transversely aligned on said lock ring that connects to said stop ring to bind said lock ring and said stop ring together to said adjustment bolt.

* * * * *

UNITED STATES PATENT AND TRADEMARK OFFICE

CERTIFICATE OF CORRECTION

PATENT NO. : 6,643,970 B2
DATED : November 11, 2003
INVENTOR(S) : Jeffrey Huber

It is certified that error appears in the above-identified patent and that said Letters Patent is hereby corrected as shown below:

Title page,
Item [57], ABSTRACT,
Lines 21 and 22, replace “stop plate” with -- stop ring --.

Signed and Sealed this

Eighteenth Day of May, 2004

JON W. DUDAS
*Acting Director of the United States Patent and Trademark Office*